US006155464A

United States Patent [19]

Vachon

[11] Patent Number: 6,155,464

[45] Date of Patent: Dec. 5, 2000

[54] NON-SPILLING DETACHABLE POURING SPOUT

[75] Inventor: Léandre Vachon, Thetford Mines, Canada

[73] Assignee: DSD International Inc., Quebec, Canada

[21] Appl. No.: 09/394,874

[22] Filed: Sep. 13, 1999

[51] Int. Cl.[7] ..... B67D 3/00

[52] U.S. Cl. ..... 222/484; 222/481.5; 141/59; 141/348; 141/291

[58] Field of Search ..... 222/484, 481.5; 141/290–296, 302, 348–352, 59

[56] References Cited

U.S. PATENT DOCUMENTS

| | | | |
|---|---|---|---|
| 1,167,589 | 1/1916 | Morgan . | |
| 2,822,832 | 2/1958 | Craw . | |
| 2,841,313 | 7/1958 | Beall, Jr. | 222/484 |
| 3,074,444 | 1/1963 | Hawksford . | |
| 3,606,096 | 9/1971 | Campbell | 222/484 |
| 4,924,921 | 5/1990 | Simmel et al. | 141/293 |
| 4,958,668 | 9/1990 | Vachon | 141/291 |
| 5,042,698 | 8/1991 | Fessell | 222/481.5 |
| 5,092,497 | 3/1992 | Toedter | 222/481.5 |
| 5,327,945 | 7/1994 | Simpson et al. | 141/290 |
| 5,419,378 | 5/1995 | Law | 222/291 |
| 5,507,328 | 4/1996 | Donovan | 141/291 |
| 5,711,355 | 1/1998 | Kowalczyk | 141/290 |

FOREIGN PATENT DOCUMENTS 1 2228 334 10/1987 Canada .

*Primary Examiner*—Andres Kashnikow
*Assistant Examiner*—Dinh Q. Nguyen
*Attorney, Agent, or Firm*—Foley & Lardner

[57] ABSTRACT

This invention relates to an improved pouring spout of the type of ones which are detachably connected to a filling container for transferring liquid in a receiving container. These kind of pouring spout include an inlet tube for receiving liquid from the filling container, and an outlet tube telescopically mounted to slide onto the inlet tube for guiding liquid therefrom into the receiving container. The spout also comprises a liquid valve which opens and closes automatically upon sliding of the outlet tube. The current invention further comprises an air passage and an air valve for regulating an air flow inside the spout from the receiving container into the receiving container, such that the flow of liquid inside the spout stops automatically when the receiving container is full, thereby avoiding spillage of liquid. The pouring spout of the invention also resolve the problem of emanations related to the transfer of dangerous volatile and highly inflammable liquid.

19 Claims, 6 Drawing Sheets

NON-SPILLING DETACHABLE POURING SPOUT

BACKGROUND OF THE INVENTION a) Field of the Invention

The present invention relates to an improved non-spilling pouring spout which can be attached to most containers for use in pouring liquid from a filling container into a receiving container, with no risk of accidental spillage and/or evaporation.

b) Brief Description of the Prior Art

Pouring spouts on containers, for use in filling other containers or tanks with liquid, are well known. In use, the container with the spout is tipped to position the spout downwardly in a filling neck on the container to be filled. During the tipping operation however, liquid can be spilled from the spout before it is properly positioned relative to the filling neck. With known spouts it is also difficult to know when the container being filled becomes full. Often the container overflows because the person filling the container cannot see past the spout in the filling neck. More liquid can be spilled when the spout is withdrawn from the filling neck. Furthermore, when transferring volatile and highly inflammable liquid, dangerous gaseous vapours escape from the receiving container. All these problems raise significant safety concerns with known spouts. This can results in dangerous explosions for the home owner refuelling his lawn mower, skin contamination for the farmer handling pesticides and herbicides, and injury for persons using liquids which are harmful upon contact with the skin, such as acid.

It is known to provide containers with spouts which have liquid valves therein to control the flow of liquids through the spouts. The liquid valves are arranged to automatically open the spout when it is inserted in the filling neck of a receiving container and to automatically close the spout when it is withdrawn from the neck. However, much of the known spouts which can be attached to a filling container do not address or offer an effective solution to the problem of spillage due to overflowing. Additionally, these known spouts do not resolve the problem of liquid spillage due to liquid left in the dispensing tube between the valve an the outlet end of the tube. When the spout is withdrawn from the receiving container, the liquid contained between the valve and the outlet end of the tube is spilled. Further, the known valve equipped spouts do not provide a locking mechanism which prevents accidental valve opening, neither they provide means for preventing evaporation. Examples of such spouts are disclosed in U.S. Pat. Nos. 1,167,589; 2,822,832; and 3,074,444.

U.S. Pat. No. 4,958,668 issued to the present inventor discloses a pouring spout which solves the problems mentioned herein above. The spout disclosed in this patent comprises an inlet tube for receiving liquid from the filling container, and an outlet tube operatively coupled to the inlet tube for guiding liquid therefrom into the receiving container. The inlet tube has an inlet portion provided with means for attaching it to the filling container, and a main portion. The outlet tube has a collar-like portion telescopically mounted onto the main portion of the outlet tube, and a short outlet portion of a smaller diameter than the inlet tube. The spout also comprises a liquid valve which includes a valve head and means for connecting the valve head to the outlet tube. The connecting means comprises a perforated plate extending across a lowermost end of the collar-like portion of the outlet tube and a pin having one end connected to a central portion of the perforated plate and another end connected to the valve head. A valve seat is disposed at substantially a lowermost end of the main portion of the inlet tube, whereby spillage of liquid contained in the spout is prevented. A spring is mounted within the collar-like portion of the outlet tube between the perforated plate and the lower most end of the main portion of the inlet tube for biasing the valve in a normally closed position. At least one stop responsive to an upward force is also mounted externally on a surface of the lowermost end of the collar-like portion of the outlet tube for opening the valve. The main portion of the inlet tube and the collar-like portion of the outlet tube are coaxial whereas the outlet portion of the outlet tube downstream the liquid valve extends at an angle substantially less than 90° with respect to this axis. According to this invention, the fact that the valve is located in close proximity to the outlet of the spout eliminates spillage upon withdrawal of the spout. However, this spout does not provide means regulating an airflow for preventing spillage of liquid when the receiving container is full, neither it resolves the problem of liquid evaporation.

Canadian patent No. 1,228,334 issued also to the present inventor, is an improvement of the structure of the pouring spout disclosed in U.S. Pat. No. 4,958,668. According to a preferred embodiment, the spout disclosed therein further comprises an air regulating means comprising a rib having a substantially central hollow passage having one end open to ambient temperature and another end opening inside the outlet portion of the inlet tube. The rib projects from a surface of the inlet tube and extends substantially parallel to said coaxis. An elongated rod is disposed in the hollow passage and an air valve is disposed inside the external rib at one end of the rod. Means are provided for biasing this air valve in a normally closed position. In addition, an elevation is disposed on the collar-like portion to the outlet tube and aligned with the other end of the rod, whereby an upward force on the stop causes this rod to contact this elevation and open the air valve. Therefore, this air regulating means provide an air passage into the filling container. Advantageously, the elevation disposed on the collar-like portion to the outlet tube is positioned in such a manner that the air valve allowing air to enter the container is actuated only when the main valve is opened ⅔ of its maximum opening. This particular embodiment prevents liquid leaks by regulating the speed wherein the liquid flows inside the spout. However, this spout do not provide an air regulating means allowing air to flow from a downstream end of the outlet tube inserted inside the receiving container, up into the filling container thereby preventing spillage of liquid when the receiving container is full. It does not either provide a solution to the problem of evaporation.

It is thus an object of the present invention to provide an economically manufactured, improved non-spilling pouring spout for use by persons of all skill levels. It is also an object of the present invention to provide a pouring spout which can be adapted to a variety of dispensing containers to permit the transfer of a broad range of liquids including fuels, paint thinner, chemicals, chlorine, and painter's ink. The problems of overflow, spillage, and evaporation associated with the transfer of these liquids from a dispensing container into a receiving container are obviated by the present invention.

The present invention also fulfils other needs which will be apparent to those skilled in the art upon reading the following specification.

SUMMARY OF THE INVENTION

An important object of the invention is the provision of efficient means for allowing air to flow inside a pouring spout devised for transferring liquid from a filling container to a receiving container. This air flow circulates from a downstream end of the spout which has been inserted inside a receiving container, up into the filling container, thereby preventing spillage of liquid when the receiving container is full and also highly reducing emanations of volatile liquids.

In accordance with the invention, this object is achieved with an improved detachable pouring spout comprising:

a) an inlet tube for receiving liquid from the filling container, the inlet tube having an inlet portion with an upstream end and a downstream end, a main portion with an upstream end and a downstream end, the downstream end of the inlet portion being adjacent to the upstream end of the main portion, the inlet portion being detachably connectable to the filling container;

b) an outlet tube operatively coupled to said inlet tube for guiding liquid therefrom into the receiving container, the outlet tube having a collar-like portion with an upstream end and a downstream end and an outlet portion with an upstream end and a downstream end, the downstream end of the collar-like portion being adjacent to the upstream end of the outlet portion, the collar-like portion being devised to be telescopically slidable onto the main portion of the inlet tube, the outlet portion being devised to be inserted inside the receiving container;

c) a liquid valve located inside the liquid passage, said liquid valve comprising:

a valve head;

means for connecting the valve head to the outlet tube, the connecting means comprising a perforated plate extending across the upstream end of the outlet portion of the outlet tube, and a pin having one end connected to a central portion of the perforated plate and another end connected to the valve head;

a valve seat inside the inlet tube substantially at the downstream end of the main portion of the inlet tube; and biasing means mounted between the perforated plate and the valve seat for biasing the valve head against the valve seat in a normally closed position;

d) stop means responsive to an upward force, the stop means being operatively connected to the liquid valve for opening said liquid valve when an upward pressure is applied to the pouring spout and thus allowing transfer of liquid from the filling container to the receiving container; and e) air regulating means operatively connected to the liquid valve, the air regulating means allowing air to flow from outside the spout into the receiving container upon actuation of the liquid valve;

wherein, in the improvement, the air regulating means includes:

an air passage extending inside the spout from the downstream end of the outlet tube up to the upstream end of the inlet tube, the passage providing an air flow entering from the downstream end of the outlet tube up into the filling container; and sealing means disposed around the main portion of the inlet tube and under the slidable collar-like of the outlet tube for coupling in a sealing manner said main portion and said slidable collar-like portion.

It is also an object of this invention to provide an improved pouring spout of the type set forth wherein the air regulating means includes a rod having a first end connected to the valve head and a second end operatively connected to an air valve. This air valve is devised to regulate the air flow inside the passage upon actuation of the liquid valve.

It is still a further object of this invention to provide an improved detachable pouring spout of the type set forth wherein the air regulating means comprises:

a) a first air channel extending inside throughout the inlet tube and a second air channel extending inside throughout the outlet tube. The first and the second air channels are operatively connected and form together the air passage;

b) an air valve located inside the inlet tube at substantially the upstream end of the inlet portion. The air valve has a portion operatively connected to the inlet tube, a bump projecting at least partially inside the first air channel and biasing means for normally biasing said bump against the first air channel in a normally closed position; and c) a rod having a first end and a second end. The rod extending from behind the liquid valve inside the inlet tube up to the second end.

The first end of the rod is operatively connected to the valve head. The second end extends at a distance away from the air valve when said liquid valve is in closed position. Therefore, the second end comes into contact with and presses against the air valve to open the same when the liquid valve is in a substantially fully opened position.

In a preferred embodiment, the outlet portion of the outlet tube is of a smaller diameter than the upstream end of the outlet portion of the outlet tube, such that once the downstream end of the outlet portion is inserted inside the receiving container the upstream end of the outlet portion of the outlet tube defines the stop means whereby an upward pressure from the receiving container can be applied to.

In another preferred embodiment, the pouring spout comprises blocking means to avoid that an upward pressure effected against the pouring spout opens the liquid valve. More preferably, the blocking means comprises a compressible handle operatively connected to an external surface of the inlet tube close to the upstream end of the outlet tube. This handle has a rest position and a compressed position. The handle prevents the collar-like portion of the outlet tube to slide onto the main portion of the inlet tube when it is set in its rest position and permits the outlet tube to slide when it is set in its compressed position.

Other objects and advantages of the present invention will be apparent from the following specification and the accompanying drawings which are for the purpose of illustration only.

DESCRIPTION OF SEVERAL PREFERRED EMBODIMENTS OF THE INVENTION

Figure 1:
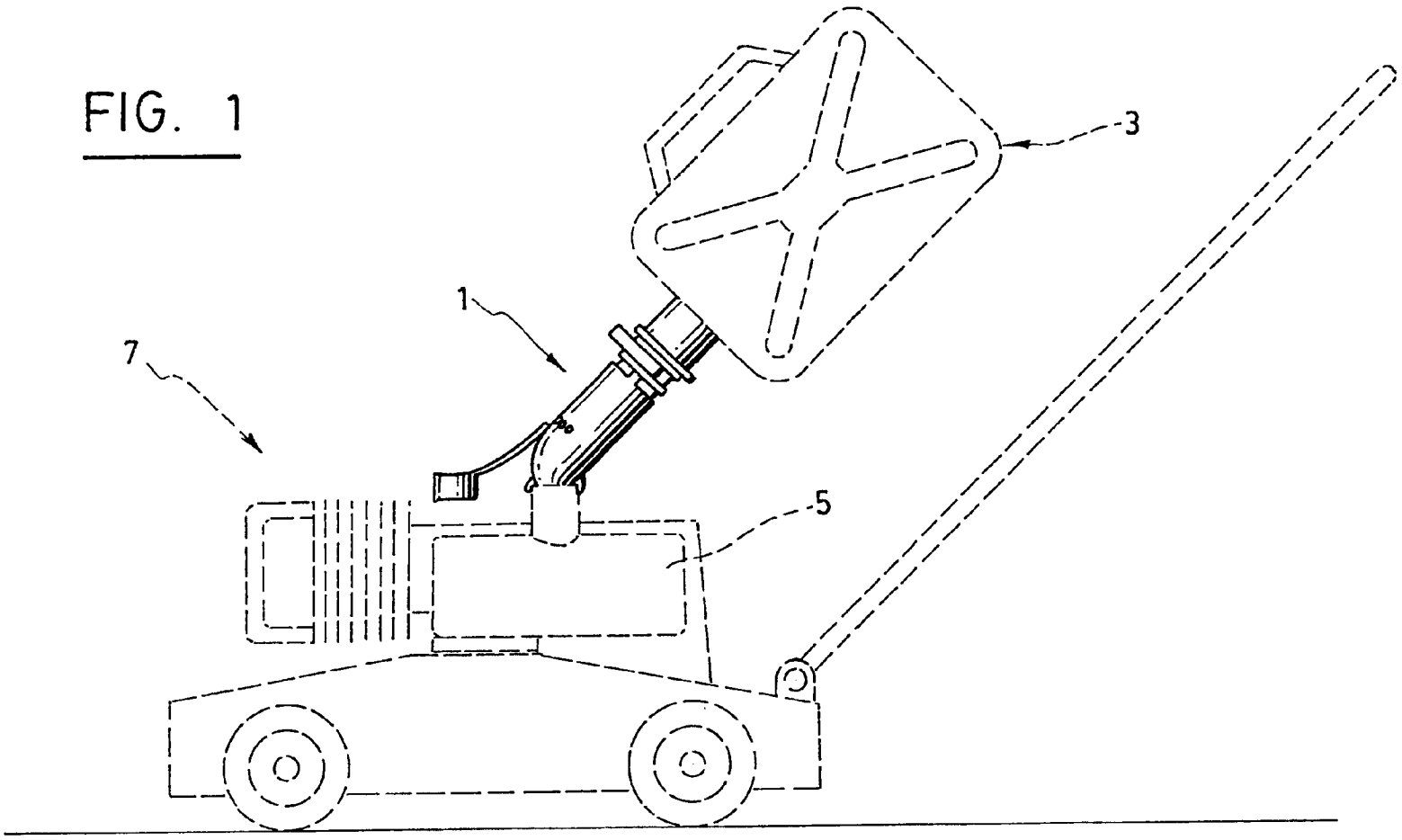
FIG. 1 is a view showing a pouring spout according to the present invention in use.

A pouring spout 1 according to the invention, is devised for transferring liquid from a filling container 3 to a receiving container 5. For example, as shown in FIG. 1, the pouring spout can be permanently or detachably mounted on a container 3 to fill a small tank 5 on a lawn mower 7 with gasoline.

Figure 3A:
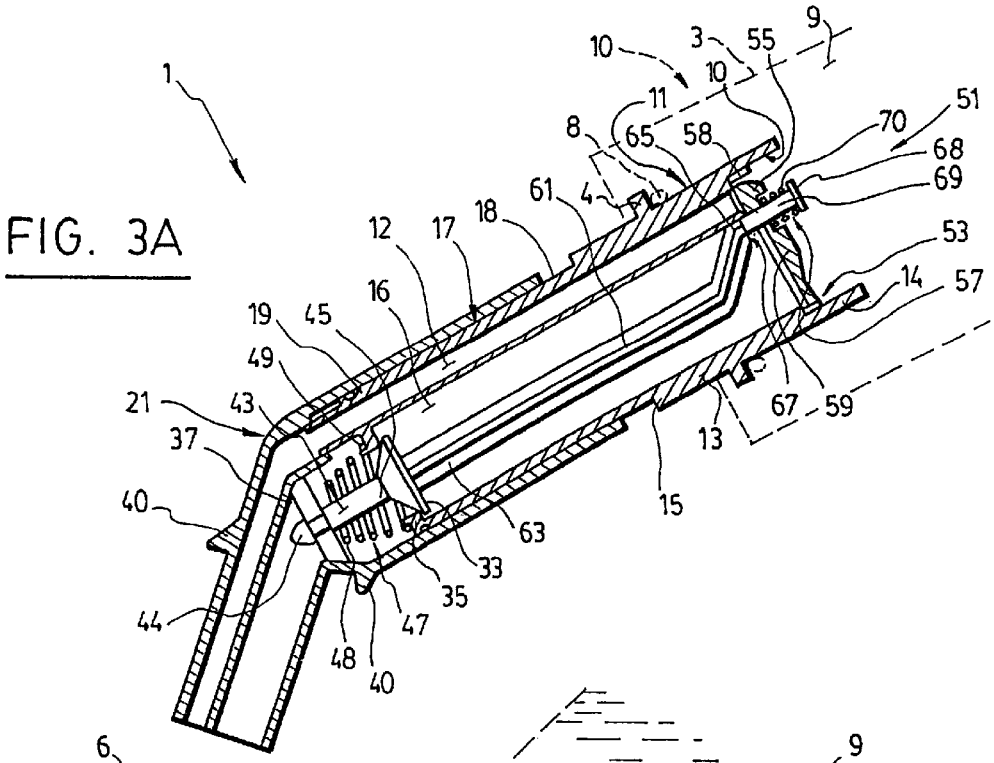
FIGS. 3A, 3B, 3C, 3D and 3E are side cross-section views of the pouring spout of the invention in use wherein a liquid valve and an air valve are in various positions.

As shown in FIG. 3A, the pouring spout 1 comprises an inlet tube 11, and an outlet tube 21. The inlet tube 11 has an inlet portion 13 with an upstream end 14 and a downstream end 15 and a main portion 17 with an upstream end 18 and a downstream end 19. The downstream end 15 of the inlet portion 13 is adjacent to the upstream end 18 of the main portion 17. The inlet tube 11 also comprises an air channel 12 and a liquid channel 16 which extend inside the inlet tube 11 from the upstream end 14 of the inlet portion 11 to the downstream end 19 of the main portion 17. Furthermore, the inlet portion 13 is provided with or operatively connected with suitable connecting means 10 for attaching the inlet tube 11 to the filling container 3. In the preferred embodiment illustrated in FIG. 3A, the connecting means 10 includes a collar (not shown) and an O-ring 8, the collar being detachably coupled to a flange 4 and screwed in a sealing manner to the filling container 3 with the help of the O-ring 8. Other types of connecting means are well known in the art.

Figure 3B:
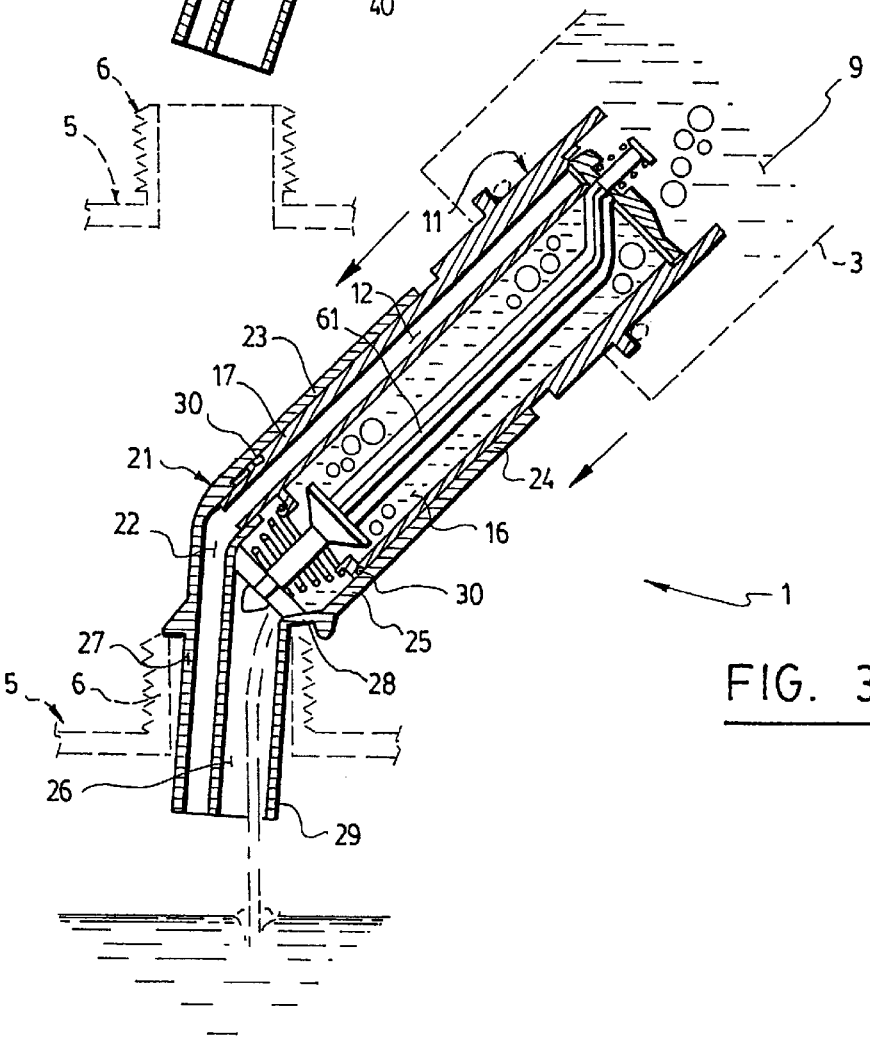

As best shown in FIG. 3B, the outlet tube 21 is operatively coupled to the inlet tube 11 for guiding liquid 8 therefrom into the receiving container. The outlet tube 21 has a collar-like portion 23 devised to be telescopically slidable onto the main portion 17 of the inlet tube 11 and an outlet portion 27 devised to be inserted inside the receiving container. The collar-like portion 23 has an upstream end 26 and a downstream end 25. The outlet portion 27 also has an upstream end 28 and a downstream end 29. The downstream end 25 of the collar-like portion 23 is adjacent to the upstream end 28 of the outlet portion 27. The outlet portion 27 is also sized to fit inside the receiving container 5. As for the inlet tube 11, the outlet tube 21 comprises an air channel 22 and a liquid channel 26 which extend inside throughout the outlet portion 27 from its upstream end 28 to its downstream end 29. As can be appreciated, the liquid channels 16, 26 of the inlet 11 and outlet tubes 21 are operatively connected together for forming a liquid passage for guiding the liquid 9 from the filling container 3 into the receiving container 5. Also, the air channels 12, 22 of the inlet 11 and outlet tubes 21 are operatively connected together for forming an air passage wherein air may flow from the downstream end 29 of the outlet tube 21 into the filling container 5. Preferably, a circular seal 30 is disposed around the main portion 17 of the inlet tube 11 and under the slidable collar-like portion 23 of the outlet tube 21. This seal 30 can be made of a rubber-like material and helps avoiding air and liquid leak from inside the spout 1.

Figure 3C:
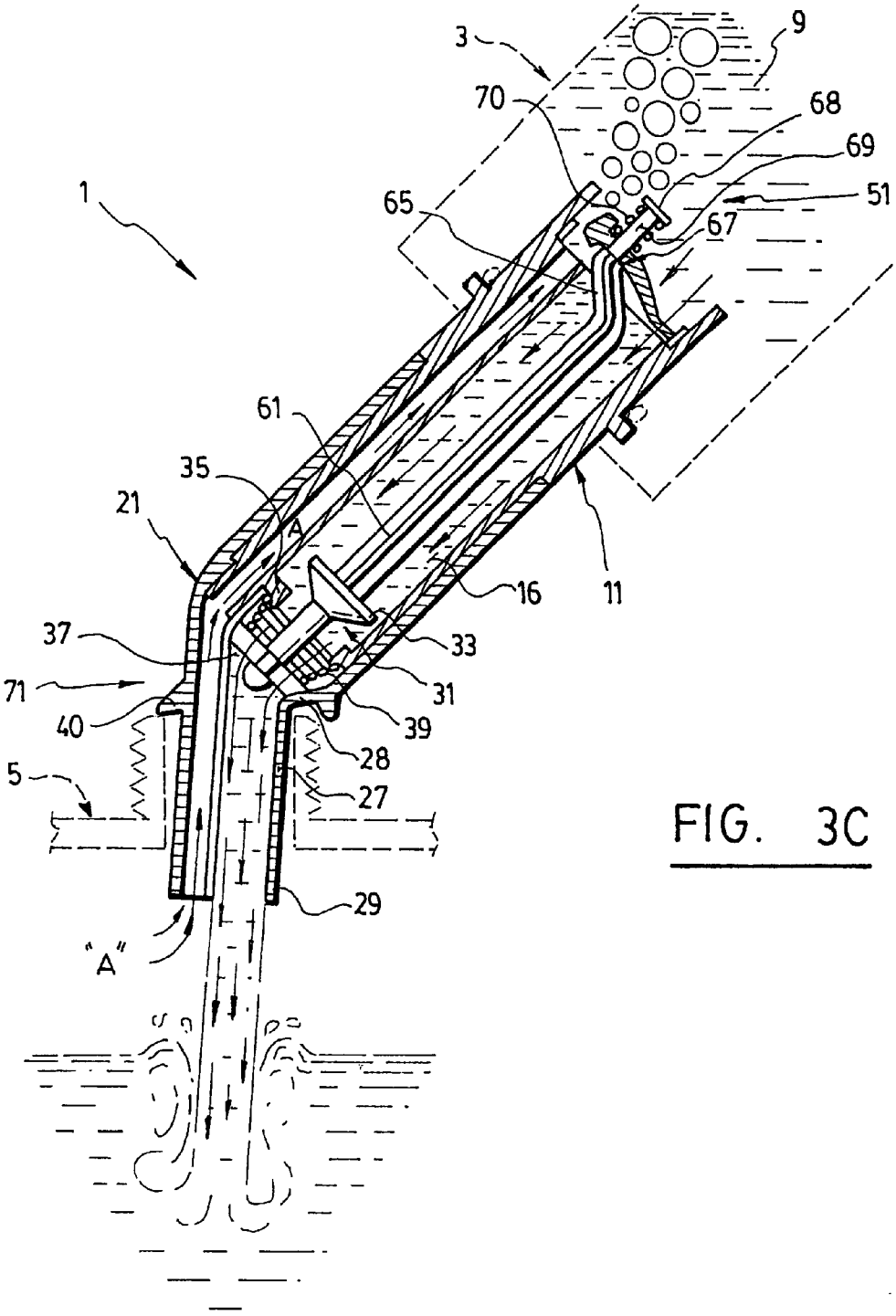

As shown in FIG. 3C, the pouring spout 1 also comprises a liquid valve 31 located inside the liquid channel 16 of the inlet tube 11. The liquid valve 31 normally closes the liquid passage and includes a valve head 33; a valve seat 35; means 37 for connecting the valve head 33 to the outlet tube 21; and biasing means 39 for biasing the valve head 33 against the valve seat 35 in a normally closed position.

As shown in FIG. 3A, the valve head 33 is preferably made of rubber-like material and it normally sits in a closed position on the valve seat 35. The valve seat 35 is fixed to the interior of the liquid channel 16 at substantially the downstream end 19 of the main portion 17 of the inlet tube 11. The valve seat 35 is preferably molded integrally to the liquid channel 16 of the inlet tube 11 and defines a circular valve opening.

FIG. 3A also shows that the means 37 for connecting the valve head 33 to the outlet tube 21 comprise a perforated plate 41 extending across the upstream end 28 of the outlet portion 27 of the outlet tube 21. The plate 41 is preferably molded integrally to the liquid channel 26 of the outlet tube 21. A pin 43 extends perpendicularly therefrom the plate 41, the pin 43 having one end 44 connected to a central portion of the perforated plate 41 and another end 45 connected to the valve head 33. The biasing means 39 are mounted between the perforated plate 41 and the valve seat 35 for biasing the valve head 33 against the valve seat 35 in a normally closed position. Preferably, the biasing means 39 comprise a spring 47 mounted around the pin 43, the spring 47 having a first end 48 biasing against the plate 41 and a second end 49 biasing against the valve seat 35.

FIG. 3A further shows that the pouring spout 1 also comprises an air valve 51 located inside the inlet tube 11 at substantially the upstream end 14 of the inlet portion 13. The air valve 51 has a portion 53 operatively connected to the inlet tube 11, a bump 55 projecting at least partially inside the air channel 12 of the inlet tube and biasing means 57 for normally biasing the bump 55 against the air channel 12 in a normally closed position. Preferably, the air valve 51 comprises a rubber-like ring 58 extending inside the inlet tube 11 and a tongue 59 extending radially therefrom. The tongue 59 comprises a bump 55 projecting perpendicularly therefrom towards the air channel 12. Preferably also, the biasing means 57 for biasing the bump 55 against the air channel 12 are operatively connected to a rod 61 as it will be explained herein below.

The spout further comprises a rod 61 having a first end 63 and a second end 65. The rod 61 extends from behind the liquid valve 31 inside the inlet tube 11 up to the second end 65. The first end 63 of the rod 61 is operatively connected to the valve head 33. The second end 65 extends at a distance away from the air valve 51 when the liquid valve 31 is in closed position as in FIG. 3A. However, the second end 65 of the rod 61 comes into contact with and presses against the air valve 51 to open the same when the liquid valve 31 is in a substantially fully opened position as in FIG. 3C.

As explained herein before, the air valve 51 preferably comprises a ring 58, a tongue 59 and a bump 55. Accordingly, the second end 65 of the rod 61 preferably comprises a wall 67 coming into contact with and pressing against the air valve 51 to open the same when the liquid valve 31 is in a substantially fully opened position as in FIG. 3C. A thin cylindrical portion 69 extends therefrom the wall 67 through the tongue 59, the cylindrical portion 69 comprising a head 68 and a spring 70. Therefore, the spring 70 and the head 68 of the rod's cylindrical portion 69 are located on a first side of the tongue 59 opposite to another side of the tongue 59 which is close to the wall 67. The spring 70 has a first end leaning against the head 68 of the cylindrical portion and a second end leaning against the tongue 59, thereby biasing the bump 55 of the tongue 59 against the first air channel 12 in a normally closed position as in FIG. 3A.

The spout 1 further comprises stop means 71 responsive to an upward force. The stop means 71 is operatively connected to the liquid valve 31 for opening the same when an upward pressure is applied to the pouring spout 1 and thus allowing transfer of liquid 9 from the filling container 3 to the receiving container 5. Preferably the downstream end 29 of the outlet portion 27 of the outlet tube 21 is of a smaller diameter than the upstream end 28 of the outlet portion 27 of the outlet tube 21. Accordingly, once the downstream end 29 of the outlet portion is inserted inside the receiving container 5, the upstream end 28 of the outlet portion 27 of the outlet tube 21 defines the stop means 71 whereby an upward pressure from the receiving container 5 can be applied to (see FIG. 3C).

In the illustrated preferred embodiments, the main portion 17 of the inlet tube 11 and the collar-like portion 23 of the outlet tube 21 are straight and coaxial, and the outlet portion 27 of the outlet tube 21 downstream the liquid valve 31 extends at an angle lower than 90° with respect to said axis. The illustrated preferred embodiments further preferably comprise a pair of opposite teeth 40 embodied on an external surface of the outlet portion 27 of the outlet tube 21. According to the exact location and shape of the teeth 40, they may be used as a spot against which the upward pressure from the receiving container 5 is applied. The teeth 40 may also help in blocking an horizontal movement of the spout 1 with respect to the receiving container 5.

Figure 2:
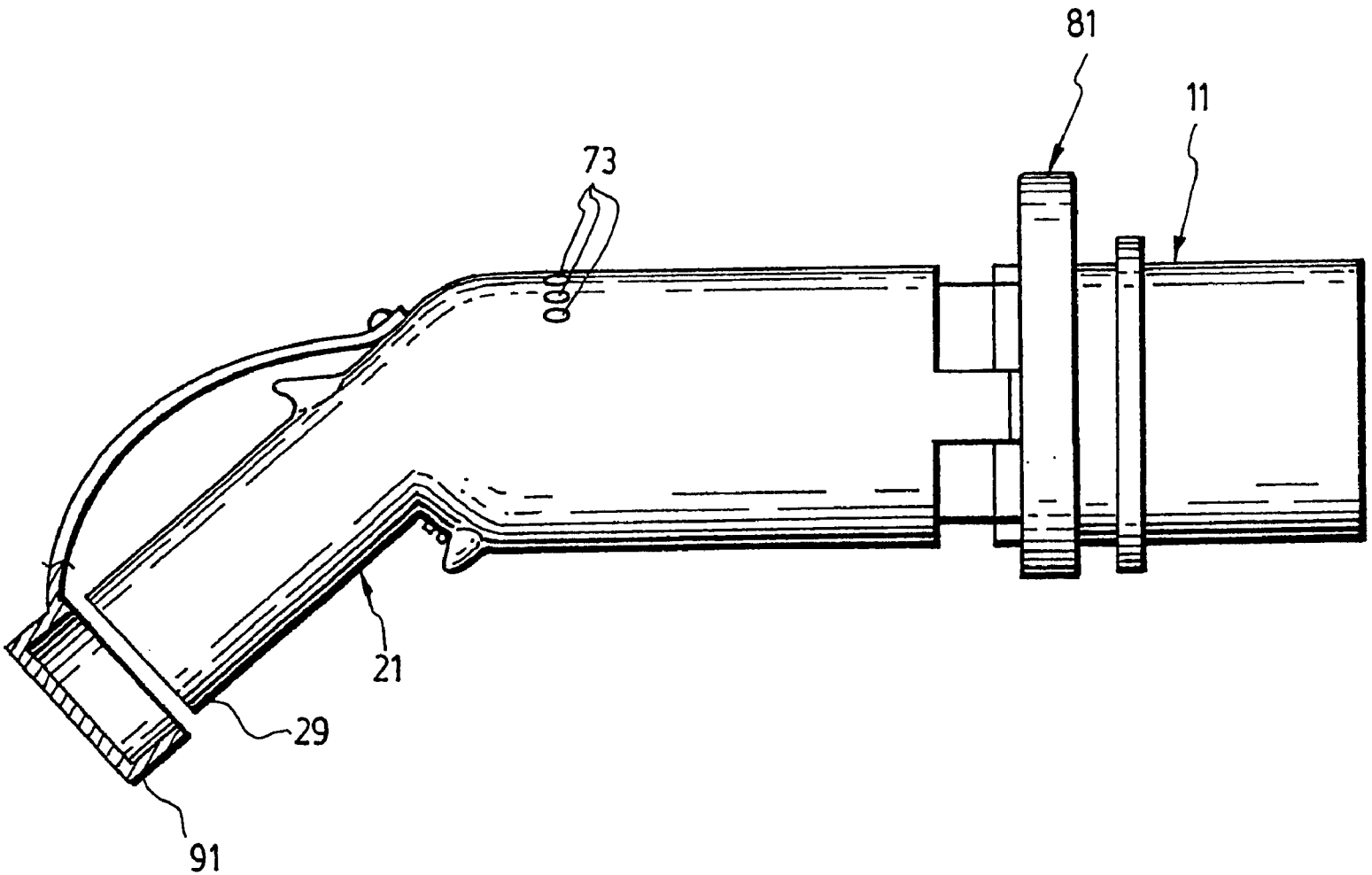
FIG. 2 is a side view of a preferred embodiment of the pouring spout according to the present invention.

As shown in FIG. 2, the pouring spout of the invention may also comprise a dust protector 91 adapted to fit on the downstream end 29 of the outlet tube 21 and blocking means 81 to avoid that an upward pressure effected against the pouring spout opens the liquid valve (not shown). The pouring spout 1 may further comprise a filter (not illustrated) disposed inside the spout 1 or at ends thereof for preventing contaminants from entering the receiving container.

FIGS. 4A, 4B, 5A and 5B show an example of a preferred blocking means 81. The illustrated blocking means comprises a compressible a handle 83. The handle 83 comprises a pair of anchoring ends 84 operatively connected to an external surface of the inlet tube 11 close to the upstream end 24 of the outlet tube 21, and a blocking end 85 extending into a slot 87. Preferably a pair of slots 87,87' extend inside the downstream end 19 of the main portion 17 of the inlet tube 11 on both side thereof. A pair of arms 89,89', having an angular end, extends towards and coaxial to the slot 85, from both sides of the upstream end 24 of the collar-like portion 23 of the outlet tube 21. Accordingly, the handle 83 has a rest position (see FIGS. 4A and 5A) wherein its blocking end 85 blocks the slot 87 to the arm 89, thereby preventing the collar-like portion 23 of the outlet tube 21 to slide onto the main portion 17 of the inlet tube 11. The handle 83 also has a compressed position (see FIGS. 4B and 5B) wherein its blocking end 85 slides out the slot 87, thereby allowing the arms 89,89' to slide into their corresponding slots 87,87' and the outlet tube 21 to slide onto the main portion 17 of the inlet tube 11. In the compressed position, the handle 83 is biased such that the blocking end 85 automatically goes back into the slot 87 once freed from the arm 89. Although not illustrated, other blocking means known in the art such as means using a blocking pin are conceivable according to the present invention.

FIGS. 3A, 3B, 3C, 3D and 3E illustrate a preferred embodiment of the pouring spout 1 of the invention in operation. The spout 1 is initially inserted down into the filling neck 6 of the tank 5 to be filled (FIG. 3A). The liquid valve 31 is normally closed by the spring 47, thus preventing any liquid 9 from passing out the spout 1 as it is positioned in the neck 6. As the spout 1 is more fully inserted into the neck 6, the teeth 40 on the outlet tube 21 contact the neck 6. The outlet tube 21 starts to smoothly and evenly slides up onto the inlet tube 11 as shown in FIG. 3B. As the outlet tube 21 slides up the pin 41 attached therein, the pin 41 moves the valve head 33 up off the valve seat 35, against the force of the spring 47, to open the liquid valve 31. This allows the liquid 9 to now enter the tank 5 being filled (FIG. 3B).

The rod 61, having its first end 63 connected to the valve head 31 will also move but the air valve 51 will remain in closed position. Indeed, 1) the cylindrical portion 59 of the rod's second end 65 will move throughout the tongue 59 of the air valve 51; 2) the wall 67 will not press against the tongue 59 because it extends at a distance away from the air valve 51. Accordingly, in the position illustrated in FIG. 3B, the flow rate of liquid 9 will be relatively slow because of a suction caused by the flowing liquid. A negative air pressure will build up into the filling container 3 and the flow of liquid will have to stop sporadically to allow air to flow inside the liquid passage, from outside the spout 1 up into the filling container 3.

FIG. 3C shows another position wherein the outlet tube 21 has slid further to fully open the liquid valve 31 and also open the air valve 51. By sliding further up onto the inlet tube 11 than in FIG. 3B, the liquid valve 31 has opened fully and moved the rod 61 accordingly. In FIG. 3C, the second end of the rod 65 thereby presses against the air valve 51 against the force of the spring 70. This allows air "A" to flow through the air passage from outside the spout 1 up into the filling container 3. The air pressure inside the filling container 3 thus equilibrates automatically as the liquid 9 flows therefrom. Accordingly, the flow rate will be relatively rapid since there is no stop. Furthermore, advantageously, the flow of air "A" highly reduces emanations of volatile liquid since these emanations will be returned back into the filling container.

Figure 3D:
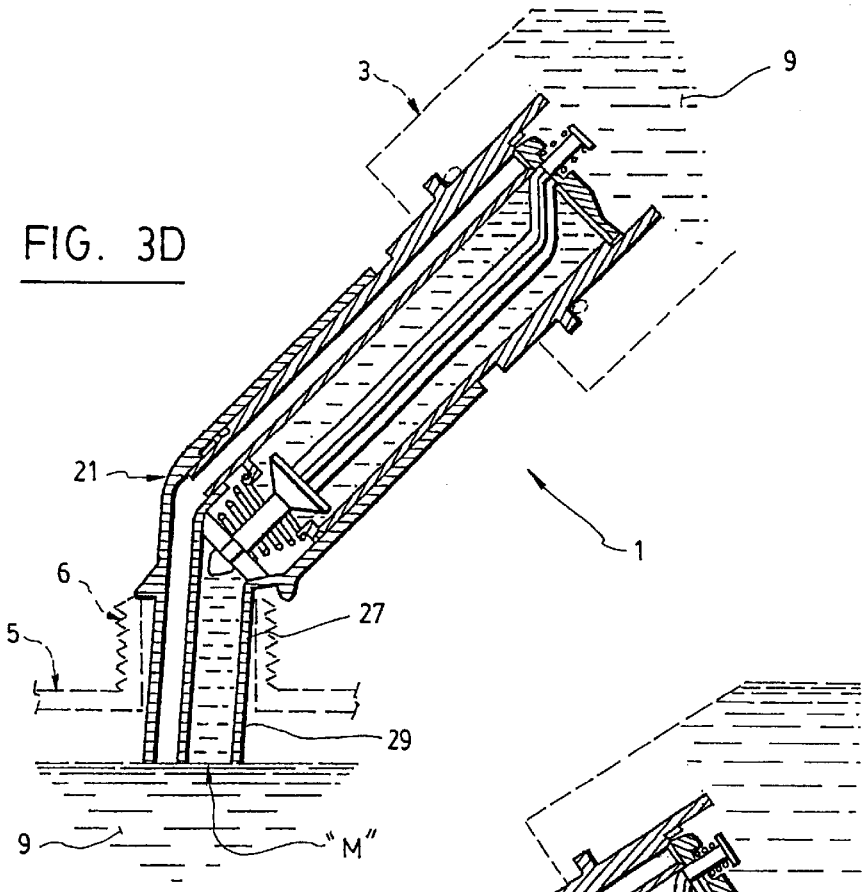
Figure 3E:
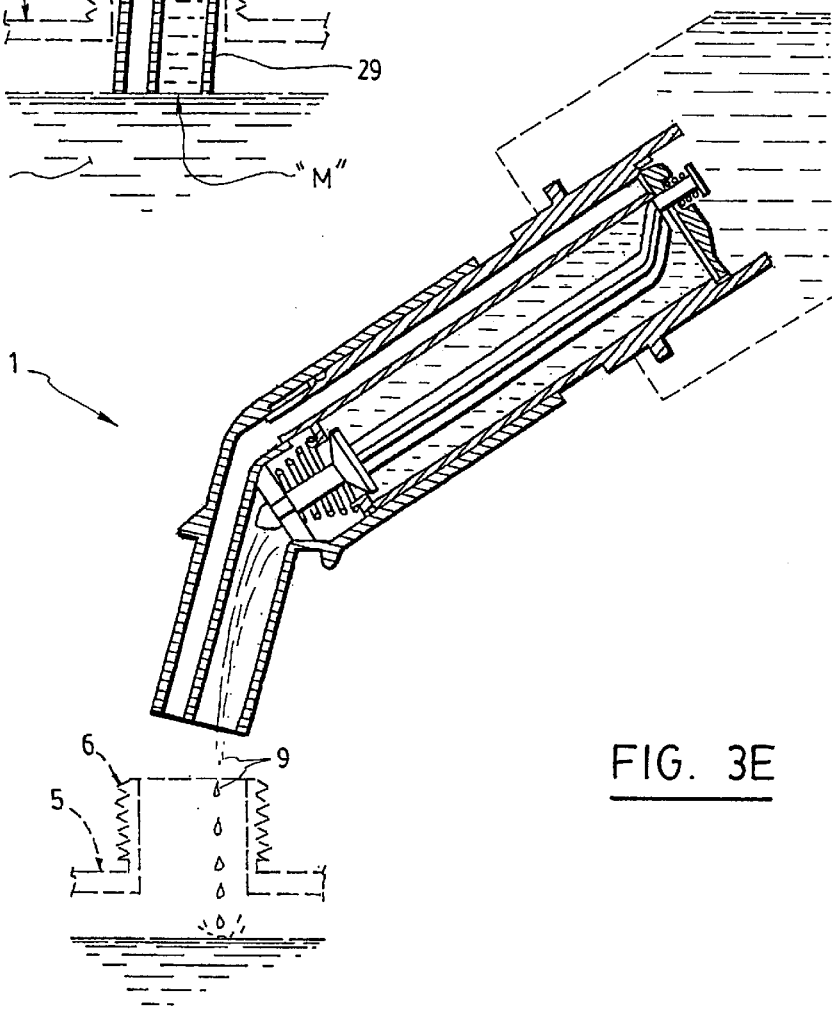
Figure 5A:
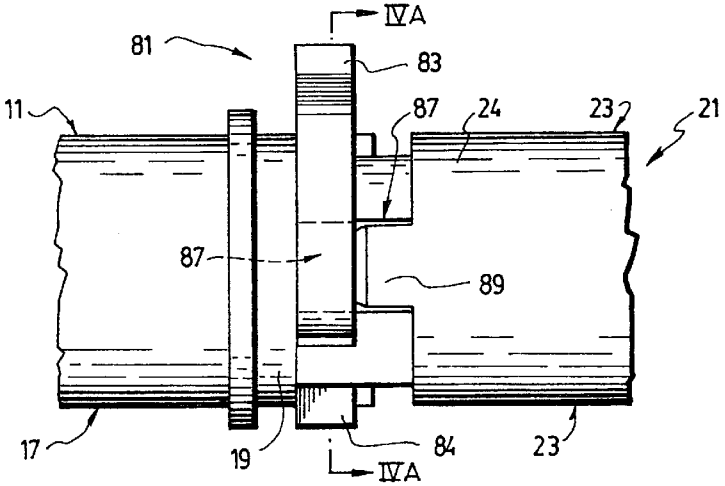
FIGS. 5A and 5B are top plan views of the blocking means of FIGS. 4A and 4B, the blocking means being in a lock (FIG. 5A) or an unlock (FIG. 5B) position.
Figure 5B:
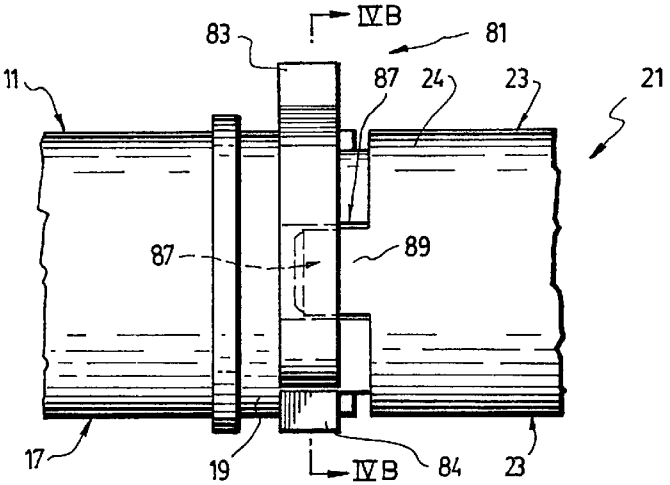
Figure 4A:
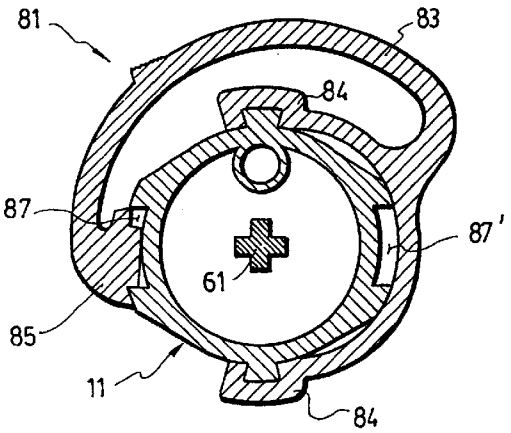
FIGS. 4A and 4B are cross-section views of a blocking means attached on an external surface of the pouring spout of the present invention, the blocking means being in a lock (FIG. 4A) or an unlock (FIG. 4B) position.
Figure 4B:
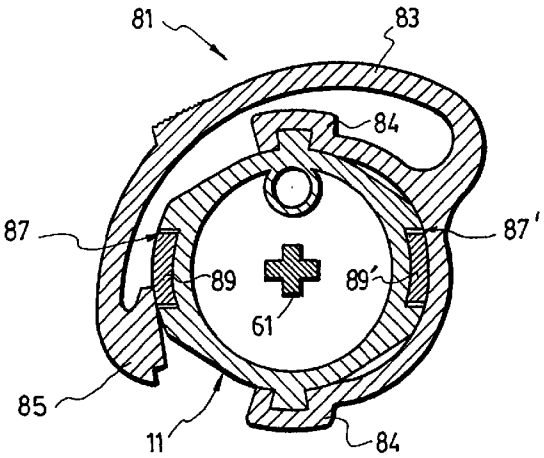

FIG. 3D shows, as a person skilled in the art can understand in view of FIGS. 3A to 3C, that the flow of liquid into the spout stops automatically when a level "M" of liquid 9 reaches the downstream end 29 of the outlet portion 27 of the outlet tube 21. At such this maximum level "M", air would not be able to flow neither into the liquid passage, nor the air passage and the negative air pressure in the filling container 3 will be sufficient to retain liquid 9 therein against gravity. Spilling of liquid over the neck 6 of the receiving container 5 will thus be avoided, another major advantage of the spout 1 of the present invention. No other pouring spout known in the art possesses this advantage.

When filling is completed, the spout 1 is withdrawn from the neck 6 of the receiving container 5. Because of the force of the spring 47 of the liquid valve 31, the outlet tube 21 will thus simultaneously slide downwardly, causing 1) the liquid valve 31 to close partially, and simultaneously, the air valve 51 to close fully; 2) subsequently causing the liquid valve 31 to close fully. Liquid 9 remaining in the outlet portion 27 of the outlet tube 21 will thus flow by itself into the receiving container 5.

As shown in FIG. 2, the spout of the invention may further comprise one or a plurality of holes 73 extending through an upper portion of the outlet tube 21. Although not visible on this Figure, the holes 73 are positioned to extend between the valve seat and the valve head of the liquid valve when the outlet tube 21 is in a downward position i.e. when the liquid valve is substantially closed. With the holes 73 air may flow from ahead of the liquid valve towards the downstream end 29 of the outlet tube 21. These holes 73 will help to empty more rapidly the outlet tube 21 from liquid remaining therein. When the outlet tube 21 is slide up onto the inlet tube 11 to open the liquid valve, the holes move accordingly to adopt a position behind the valve head and the circular seal disposed around the main portion of the inlet tube 11 thereby preventing liquid to leak therefrom.

The pouring spout 1 can be made of non-corrosive material such as plastic so that corrosive liquids can be safely transferred without damaging the spout 1 structure.

While several embodiments of the invention have been described, it will be understood that the present invention is capable of further modification, and this application is intended to cover any variations, uses, or adaptation of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. In a non-spilling detachable pouring spout for transferring liquid from a filling container to a receiving container, said spout comprising:

a) an inlet tube for receiving liquid from the filling container, said inlet tube having an inlet portion with an upstream end and a downstream end, a main portion with an upstream end and a downstream end, the downstream end of the inlet portion being adjacent to the upstream end of the main portion, the inlet portion being detachably connectable to the filling container;

b) an outlet tube operatively coupled to said inlet tube for guiding liquid therefrom into the receiving container, said outlet tube having a collar-like portion with an upstream end and a downstream end and an outlet portion with an upstream end and a downstream end, the downstream end of the collar-like portion being adjacent to the upstream end of the outlet portion, the collar-like portion being devised to be telescopically slidable onto the main portion of the inlet tube, the outlet portion being devised to be inserted inside the receiving container;

c) a liquid valve located inside the liquid passage, said liquid valve comprising:

a valve head;

means for connecting the valve head to the outlet tube, said connecting means comprising a perforated plate extending across the upstream end of the outlet portion of the outlet tube, and a pin having one end connected to a central portion of the perforated plate and another end connected to the valve head;

a valve seat inside the inlet tube substantially at the downstream end of the main portion of the inlet tube; and biasing means mounted between the perforated plate and the valve seat for biasing the valve head against the valve seat in a normally closed position;

d) stop means responsive to an upward force, said stop means being operatively connected to the liquid valve for opening said liquid valve when an upward pressure is applied to the pouring spout and thus allowing transfer of liquid from the filling container to the receiving container; and e) air regulating means operatively connected to the liquid valve, said air regulating means allowing air to flow from outside the spout into the receiving container upon actuation of the liquid valve;

the improvement wherein the air regulating means includes:

an air passage extending inside the spout from the downstream end of the outlet tube up to the upstream end of the inlet tube, said passage providing an air flow entering from the downstream end of the outlet tube up into the filling container; and sealing means disposed around the main portion of the inlet tube and under the slidable collar-like of the outlet tube for coupling in a sealing manner said main portion and said slidable collar-like portion.

2. The pouring spout according to claim 1, wherein the air regulating means includes a rod having a first end connected to the valve head and a second end operatively connected to an air valve, the air valve being devised to regulate an air flow inside said passage upon actuation of the liquid valve.

3. The pouring spout according to claim 1, wherein said air regulating means comprises:

a) a first air channel extending inside throughout the inlet tube and a second air channel extending inside throughout the outlet portion of the outlet tube, said first and second air channels being operatively connected and forming together the air passage;

b) an air valve located inside the inlet tube at substantially the upstream end of the inlet portion, the air valve having a portion operatively connected to the inlet tube, a bump projecting at least partially inside the first air channel and biasing means for normally biasing said bump against the first air channel in a normally closed position; and c) a rod having a first end and a second end, the rod extending from behind the liquid valve inside the inlet tube up to the second end, the first end of said rod being operatively connected to the valve head, the second end extending at a distance away from the air valve when said liquid valve is in closed position, the second end coming into contact with and pressing against the air valve to open the same when the liquid valve is in a substantially fully opened position.

4. The pouring spout according to claim 3, wherein the downstream end of the outlet portion of the outlet tube is of a smaller diameter than the upstream end of the outlet portion of the outlet tube, such that once the downstream end of the outlet portion inserted inside the receiving container the upstream end of the outlet portion of the outlet tube defines said stop means whereby an upward pressure from the receiving container can be applied to.

5. The pouring spout according to claim 3, wherein the main portion of the outlet tube and the collar-like portion of the outlet are straight and coaxial and wherein the outlet portion of the outlet tube downstream the liquid valve extends at an angle lower than 90° with respect to said axis.

6. The pouring spout according to claim 3, wherein the sealing means comprise at least one circular seal.

7. The pouring spout according to claim 3, wherein the biasing means for biasing the liquid valve and/or the air valve comprises a spring.

8. The pouring spout according to claim 3, wherein the stop means comprises at least one tooth embodied on an external surface of the outlet portion of the outlet tube.

9. The pouring spout according to claim 3, wherein the air valve comprises a ring extending inside the inlet tube and a tongue extending radially therefrom, said tongue comprising a bump projecting perpendicularly therefrom towards said first air channel.

10. The pouring spout according to claim 9, wherein the second end of the rod comprises:

a wall coming into contact with and pressing against the air valve to open the same when the liquid valve is in a substantially fully opened position;

a cylindrical portion extending therefrom the wall through the tongue, the cylindrical portion comprising a head and a spring, said spring and head being located on a first side of the tongue opposite to a second side of the tongue close to the wall, said spring having a first end leaning against the head of said cylindrical portion and a second end leaning against the tongue, the spring and the head cooperating together for biasing the bump of the tongue against the first air channel in a normally closed position.

11. The pouring spout according to claim 3, wherein the pouring spout comprises blocking means to avoid that an upward pressure effected against the pouring spout opens said liquid valve.

12. The pouring spout according to claim 11, wherein the blocking means comprise a compressible handle operatively connected to an external surface of the inlet tube close to the upstream end of the outlet tube, said handle having a rest position and a compressed position, the handle preventing the collar-like portion of the outlet tube to slide onto the main portion of the inlet tube when in said rest position and permitting said outlet tube to slide when in said compressed position.

13. A pouring spout according to claim 3, further comprising a dust protector adapted to fit on the downstream end of the outlet tube.

14. A pouring spout according to claim 3, further comprising a filter disposed for preventing contaminants from entering the receiving container.

15. A pouring spout according to claim 3, which is made of plastic material.

16. A pouring spout according to claim 3, further comprising at least an air hole extending through an upper portion of the outlet tube between the valve seat and the valve head, said at least one air hole allowing air to flow from ahead of said valve towards the downstream end of the outlet tube when said valve is in a substantially closed position thereby promoting emptying of the outlet tube from liquid remaining therein once the liquid valve is closed.

17. A pouring spout according to claim 3, wherein the connecting means includes a collar and a O-ring, the collar being detachably coupled to the spout and screwable in a sealing manner to the filling container.

18. A non-spilling detachable pouring spout for transferring liquid from a filling container to a receiving container, said spout comprising:

a) an inlet tube for receiving liquid from the filling container, said inlet tube having:
   - an inlet portion with an upstream end and a downstream end, the inlet portion being detachably connectable to the filling container,
   - a main portion with an upstream end and a downstream end, the downstream end of the inlet portion being adjacent to the upstream end of the main portion, and
   - a first air channel and a first liquid channel extending inside the inlet tube from the upstream end of the inlet portion to the downstream end of the main portion;

b) an outlet tube operatively coupled to said inlet tube for guiding liquid therefrom into the receiving container, said outlet tube having:
   - a collar-like portion with an upstream end and a downstream end, the collar-like portion being devise to be telescopically slidable onto the main portion of the inlet tube,
   - an outlet portion having an upstream end and a downstream end, the downstream end of the collar-like portion being adjacent to the upstream end of the outlet portion, the downstream end of the outlet portion being devised to be inserted inside the receiving container, and
   - a second air channel and a second liquid channel extending inside throughout the outlet portion of the outlet tube, the first and second liquid channels being operatively connected together for forming a liquid passage for guiding the liquid from the filling container into the receiving container, the first and second air channels being operatively connected for forming together an air passage extending throughout inside the pouring spout wherein air may flow from the downstream end of the outlet tube into the filling container;

c) sealing means disposed around the main portion of the inlet tube and under the slidable collar-like of the outlet tube for coupling in a sealing manner said main portion and said slidable collar-like portion;

d) a liquid valve located inside the liquid passage, said liquid valve comprising:
   - a valve head;
   - means for connecting the valve head to the outlet tube, said connecting means comprising a perforated plate extending across the upstream end of the outlet portion of the outlet tube, and a pin having one end connected to a central portion of said perforated plate and another end connected to the valve head;
   - a valve seat inside the inlet tube substantially at the downstream end of the main portion of the inlet tube; and
   - biasing means mounted between the perforated plate and the valve seat for biasing the valve head against the valve seat in a normally closed position;

d) an air valve located inside the inlet tube at substantially the upstream end of the inlet portion, the air valve having a portion operatively connected to the inlet tube, a bump projecting at least partially inside the first air channel and biasing means for normally biasing said bump against the first air channel in a normally closed position;

e) a rod having a first end and a second end, the rod extending from behind the liquid valve inside the inlet tube up to the second end, the first end of said rod being operatively connected to the valve head, the second end extending at a distance away from the air valve when said liquid valve is in closed position, the second end coming into contact with and pressing against the air valve to open the same when the liquid valve is in a substantially fully opened position; and f) stop means responsive to an upward force, said stop means being operatively connected to the liquid valve for opening said liquid valve when an upward pressure is applied to the pouring spout and thus for allowing transfer of liquid from the filling container to the receiving container.

19. The pouring spout according to claim 18, wherein the air valve comprises a ring extending inside the inlet tube and a tongue extending radially therefrom, said tongue comprising a bump projecting perpendicularly therefrom towards said first air channel and wherein the second end of the rod comprises:

- a wall coming into contact with and pressing against the air valve to open the same when the liquid valve is in a substantially fully opened position;
- a thin cylindrical portion extending therefrom said wall through said tongue, said cylindrical portion comprising a head and a spring on a side of the tongue opposite to said wall, said spring having a first end leaning against the head of the cylindrical portion and a second end leaning against the tongue thereby biasing said bump against the first air channel in a normally closed position.

* * * * *